US009870757B2

(12) United States Patent
Genoe

(10) Patent No.: US 9,870,757 B2
(45) Date of Patent: Jan. 16, 2018

(54) LOW POWER DIGITAL DRIVING OF ACTIVE MATRIX DISPLAYS

(71) Applicants: IMEC VZW, Leuven (BE); Nederlandse Organisatie voor Toegepast-Natuurwetenschappelijk Onderzoek TNO, 's Gravenhage (NL)

(72) Inventor: Jan Genoe, Messelbroek (BE)

(73) Assignees: IMEC VZW, Leuven (BE); Nederlandse Organisatie voor Toegepast-Natuurwetenschappelijk Onderzoek TNO, 'S-Gravenhage (NL)

( * ) Notice: Subject to any disclaimer, the term of this patent is extended or adjusted under 35 U.S.C. 154(b) by 132 days.

(21) Appl. No.: 14/647,250

(22) PCT Filed: Nov. 25, 2013

(86) PCT No.: PCT/EP2013/074635
§ 371 (c)(1),
(2) Date: May 26, 2015

(87) PCT Pub. No.: WO2014/080014
PCT Pub. Date: May 30, 2014

(65) Prior Publication Data

US 2015/0317951 A1 Nov. 5, 2015

Related U.S. Application Data

(60) Provisional application No. 61/729,738, filed on Nov. 26, 2012.

(51) Int. Cl.

| | |
|---|---|
| ***G09G 5/18*** | (2006.01) |
| ***G09G 3/32*** | (2016.01) |
| ***G09G 3/3283*** | (2016.01) |

(52) U.S. Cl.
CPC ..... *G09G 5/18* (2013.01); *G09G 3/3283* (2013.01); *G09G 2300/0852* (2013.01); *G09G 2320/0693* (2013.01); *G09G 2330/021* (2013.01)

(58) Field of Classification Search
CPC ... G09G 2300/0852; G09G 2320/0693; G09G 2330/021; G09G 3/3283; G09G 5/18
See application file for complete search history.

(56) References Cited

U.S. PATENT DOCUMENTS 7,138,967 B2 * 11/2006 Kimura ..... G09G 3/3241 315/169.3
7,859,520 B2 * 12/2010 Kimura ..... G09G 3/3241 345/173

(Continued)

OTHER PUBLICATIONS

PCT International Search Report and Written Opinion, PCT International Application No. PCT/EP20131074635, dated Jan. 29, 2014.

*Primary Examiner* — Afroza Chowdhury
(74) *Attorney, Agent, or Firm* — McDonnell Boehnen Hulbert & Berghoff LLP

(57) ABSTRACT

Digital driving circuitry for driving an active matrix display comprising a plurality of pixels logically organized in a plurality of rows and a plurality of columns, each pixel comprising a light emitting element, comprises a current driver for each of the plurality of columns for driving a predetermined current through the corresponding column, the predetermined current being proportional to the number of pixels that are ON in that column. The digital driving circuitry further comprises digital select line driving circuitry for sequentially selecting the plurality of rows, and digital data line driving circuitry for writing digital image codes to the pixels in a selected row, synchronized with the digital select line driving circuitry.

10 Claims, 12 Drawing Sheets

(56) References Cited

U.S. PATENT DOCUMENTS

| | | | | |
|---|---|---|---|---|
| 8,004,875 | B2 * | 8/2011 | Siegert | G11O 5/025 365/100 |
| 8,599,109 | B2 * | 12/2013 | Kimura | G09G 3/3241 345/73 |
| 2003/0090447 | A1 | 5/2003 | Kimura | |
| 2007/0052635 | A1 * | 3/2007 | Kimura | G09G 3/3241 345/76 |
| 2008/0180463 | A1 * | 7/2008 | Ogura | G09G 3/325 345/690 |
| 2009/0001884 | A1 * | 1/2009 | Nakanishi | G09G 3/3233 313/505 |
| 2009/0009498 | A1 * | 1/2009 | Nishimura | G09G 3/3688 345/205 |
| 2011/0007550 | A1 * | 1/2011 | Siegert | G11O 5/025 365/148 |
| 2011/0134163 | A1 | 6/2011 | Kimura | |

* cited by examiner

LOW POWER DIGITAL DRIVING OF ACTIVE MATRIX DISPLAYS

CROSS-REFERENCE TO RELATED APPLICATIONS

The present application is a U.S. national stage entry of International Application No. PCT/EP2013/074635 filed Nov. 25, 2013, which claims priority to U.S. Provisional Patent Application No. 61/729,738 filed on Nov. 26, 2012, the contents of each of which are hereby incorporated by reference.

FIELD OF THE INVENTION

The present invention relates to devices and methods for low power digital driving of displays. More specifically it relates to devices and methods for compensating and digitally driving active matrix displays, such as for instance AMOLED (Active Matrix Organic Light Emitting Diode) displays.

BACKGROUND OF THE INVENTION

Current state of the art backplanes for active matrix displays, for instance AMOLED displays, use a pixel driver circuit for each light emitting element, for instance each OLED, each pixel driver circuit driving a predetermined current through the corresponding light emitting element. Multiple pixel driver circuit schematics are being implemented, which all comprise a drive transistor driving the predetermined current through the light emitting element. One example is illustrated in FIG. 1, where a light emitting element, an OLED 101 in this case, is coupled in series with a drive transistor M1 between a supply voltage VDD and ground GND. The gate of the drive transistor M1 is connected to a main electrode of a select transistor M2, the gate of which is connected to a select line SA, and the second main electrode of which is connected to a data line DA. A capacitor C1 is coupled between the gate of the drive transistor M1 and the electrode of the OLED 101 coupled to the drive transistor M1.

In an analog driving method an amplitude modulation approach is used, wherein each light emitting element, e.g. OLED, emits light during a full frame period with an intensity corresponding to the required gray level. The current through the light emitting elements, e.g. OLEDs, is determined in accordance with an analog data voltage on the gate of the drive transistor M1. As this transistor M1 preferably operates in saturation for accurate current control, e.g. in order to eliminate or substantially reduce differences in luminance between different light emitting elements, e.g. OLEDs, due to differences in light emitting element, e.g. OLED, threshold voltage, such backplanes are typically driven at power voltages beyond 8 V. The voltage drop over the drive transistor is far higher (typically larger than 4V) than the voltage drop over the light emitting element. This results in more energy being dissipated in the backplane than in the light emitting element. The current through the light emitting element (and thus the light emitting element luminance) varies with the square of the M1 gate voltage. This introduces non-linearities in the display response, limits accuracy and makes the display sensitive to noise.

In a digital driving method a Pulse Width Modulation (PWM) approach can be used, wherein each light emitting element, e.g. OLED, emits light during a portion of a frame period, at a single luminance. In this approach the portion of the frame period during which a light emitting element emits light has a duration corresponding to the required gray level. In an active matrix display, e.g. an AMOLED display, using digital driving based on pulse width modulation, it is preferable to operate the drive transistors in the linear regime to reduce the power consumption of the display. However, when the drive transistor operates in the linear regime there is a variation of electric current through the light emitting elements due to variations in light emitting element characteristics, transistor characteristics or device temperature, and/or due to degradation of the light emitting elements with time. These effects are particularly visible in AMOLED displays. They produce degradation of the image which may lead to, for instance, screen burn-in. Besides, in particular in case of AMOLED colour displays, however not limited thereto, the degradation is uneven in the different colours (blue normally degrades faster than the other colours). Therefore, compensation circuits are typically used for each pixel, resulting in relatively complex pixel driver circuits, with an increased pixel size.

As an alternative to using compensation circuits, methods have been proposed for directly controlling the current through the light emitting elements, e.g. OLEDs, in a digitally driven display. Examples of such driving methods are described in US 2011/0134163. In this approach, each pixel of a display has a current supply circuit, a switch portion and a light emitting element connected in series between a power supply reference line and a power supply line. The switch portion is switched between ON and OFF using a digital video signal. The current supply circuit causes a constant current flowing through the light emitting element (e.g. OLED). Despite that, with this approach, each light emitting element can emit light at a constant luminance even when the current characteristic is changed (for example due to degradation), it is a disadvantage of this solution that the resolution of the display is reduced. The reason is that providing a current supply circuit in each pixel results in a complex pixel circuit with an increased pixel size and thus lower resolution. Also the accuracy of such in-pixel current control may be limited because of transistor matching issues.

SUMMARY OF THE INVENTION

It is an object of embodiments of the present invention to provide good methods for digital driving of active matrix displays, such as for instance, but not limited thereto, AMOLED displays.

The above objective is accomplished by a method and device according to embodiments of the present invention.

Aspects of the present invention relate to digital driving circuitry for driving active matrix displays, and to methods for digital driving of active matrix displays, which may comprise pixel drive transistors operating in the linear regime, wherein the size and complexity of the pixel circuits are reduced as compared to existing solutions, and with a good control of the current through the light emitting elements.

One aspect relates to digital driving circuitry for driving an active matrix display such as an AMOLED display, comprising a plurality of pixels logically organized in a plurality of rows and a plurality of columns. Each pixel comprises a light emitting element such as an OLED. The driving circuitry comprises a current driver for each of the plurality of columns for driving a predetermined current through the corresponding column, the predetermined current being proportional to the number of pixels, and hence their light emitting elements, e.g. OLEDS, that are ON in that column. The digital driving circuitry further comprises digital select line driving circuitry for sequentially selecting the plurality of rows, and digital data line driving circuitry for writing digital image codes to the pixels in a selected row, synchronized with the digital select line driving circuitry.

It is an advantage of embodiments of the present invention that transistors can be driven in linear mode, reducing power consumption as compared to systems driven in saturation, enabling a reduction of circuit complexity, reducing cross talk, and enabling a reduction of channel length and increase of channel width of drive transistors. It is another advantage of embodiments of the present invention that current control can be done using an external IC, hence more accurate. It is an additional advantage that the extra illumination control in the driving circuit may reduce the problems of reduced visibility in bright ambient light.

It is an advantage of embodiments of the present invention that a unique current control is needed for each column, instead of for each pixel. This simplifies the complete driving circuitry. A display may comprise a backplane, and in digital driving circuitry according to embodiments of the present invention the current driver circuitry may be external to the backplane. This allows a compact display circuitry and higher resolution.

In embodiments of the present invention, the current driver circuitry comprises monocrystalline semiconductor-based circuits. This has the advantage that the driving circuitry is highly homogeneous, minimizing or even avoiding problems of transistor-to-transistor variation and thus offering very good transistor matching.

In embodiments of the present invention each current driver contains a counter for storing a natural number equal to the number of light emitting elements, e.g. OLEDs, that is ON in the corresponding column at a given moment in time. Updating of the natural number stored in the counter is synchronized with the select line driving circuit and is done responsive to changes in digital image data present in the data line circuit. It is an advantage of embodiments of the present invention that the display can be changed in real time with a good stability of illumination.

Upon changing the status of a light emitting element, e.g. OLED, in a given column from OFF to ON based on digital image data, the number stored in the counter is increased by 1. Upon changing the status of a light emitting element, e.g. OLED, in a given column from ON to OFF based on digital image data, the number stored in the counter is decreased by 1. The predetermined current driven through the corresponding column is equal to the natural number stored in the counter multiplied with a predetermined reference current. Hereto, the counter may be an up/down counter. The counter can be implemented easily, for instance by means of an IC.

In embodiments of the present invention each current driver drives the predetermined current between a first line with a first resistive path and a second line with a second resistive path that are matched in resistance, such that resistive paths are substantially equal over the length of the first and second lines for all light emitting elements, e.g. OLEDs, in a given column. It is an advantage of embodiments of the present invention that resistive drops are independent of the number of ON pixels. Resistance matching can be realized by design or it can be realized by technology. For example, resistance matching can be obtained by connecting the top electrode of each light emitting element, e.g. OLED, back to the metal layer used in the backplane and matching the resistances by design.

In embodiments of the present invention, the active matrix display, e.g. AMOLED display, contains a backplane comprising a pixel driving circuit connectable to the plurality of light emitting elements of the display, wherein each pixel driving circuit comprises means for compensating differences in voltage drop between different pixels in a column, the voltage drop being determined over the series connection of the light emitting element, e.g. OLED, and the pixel driving circuit. It is an advantage of embodiments of the present invention that the compensation corrects differences in the output due to differences in transistor characteristics, differences in light emitting element characteristics, temperature changes, degradation in time.

In embodiments of the present invention, the compensation means may comprise means for applying digital compensation. In this case, compensation can be applied using only small digital components. Alternatively, the compensation means may comprises means for analog compensation. In this case compensation can for instance be done by increasing the voltage drop, which is easy to implement.

Another aspect of the present invention relates to a method for driving an active matrix display, e.g. an AMOLED display, the display comprising a plurality of pixels logically organized in a plurality of rows and a plurality of columns. Each pixel may comprise a light emitting element, e.g. an OLED. The method comprises: sequentially selecting each of the plurality of rows using digital select line driving circuitry, writing digital image data to the pixels in a selected row using digital data line driving circuitry, and driving a predetermined current through each column, the predetermined current for a given column being proportional to the number of pixels that are ON in that column.

In particular embodiments of the present invention, the driving circuitry may be used to drive an active matrix display, for instance an AMOLED display (hence, the pixels may comprise OLEDs as light emitting elements), but the present invention is not limited thereto. Digital select line driving circuitry can be used for sequentially selecting each of the plurality of rows. Digital data line driving circuitry can be used for writing digital image data to the pixels in a selected row.

It is an advantage of embodiments of the present invention that current control is improved due to higher accuracy of current through each pixel in a given column, without the requirement for a pixel-based current control.

In embodiments of the present invention, the method further comprises, for each column, storing a natural number equal to the number of pixels or light emitting elements, e.g. OLEDs, that is ON in that column at a given moment in time. The method further comprises updating the natural number in synchronization with the select line driving circuitry and in accordance with changes in digital image data. It is advantageous that the current through each column is updated depending on the data to be displayed, as this allows equal brightness to be obtained in all pixels equally driven.

Upon changing the status of a light emitting element, e.g. OLED, in a given column from OFF to ON based on digital image data, the natural number is increased by 1. Upon changing the status of a light emitting element, e.g. OLED, in a given column from ON to OFF based on digital image data, the natural number is decreased by 1. Driving the predetermined current through the corresponding column comprises driving a current that is equal to the stored natural number multiplied with a predetermined reference current.

In embodiments of the present invention, the method may further comprise performing a calibration procedure, thereby determining a preferred voltage drop for each column and imposing that preferred voltage drop, by means of a compensation circuit being part of the pixel driving circuit, for each of the pixels in the corresponding column. The voltage drop may be determined as a voltage difference over the series connection of the light emitting element, e.g. OLED, and the pixel driving circuit. the compensation corrects differences in the output due to changes in temperature, aging, etc.

It is an advantage of embodiments of the present invention that the current through the light emitting elements, e.g. OLEDs, is controlled at the column level instead of at the pixel level. This approach allows current control by external integrated circuits, e.g. silicon integrated circuits, thus allowing more accurate current control. These external integrated circuits can for instance be monocrystalline silicon based circuits, yielding very low transistor-to-transistor variation and thus offering very good matching.

It is an advantage of embodiments of the present invention that the complexity of the pixel circuits can be reduced, and that a good resolution can be obtained.

Particular objects and advantages of various aspects and embodiments of the present invention have been described herein above. Of course, it is to be understood that not necessarily all such objects or advantages may be achieved in accordance with any particular embodiment of the present invention. Thus, for example, those skilled in the art will recognize that the present invention may be embodied or carried out in a manner that achieves or optimizes one advantage or group of advantages as taught herein without necessarily achieving other objects or advantages as may be taught or suggested herein. Further, it is understood that this summary is merely an example and is not intended to limit the scope of the invention. Embodiments of the invention, both as to organization and method of operation, together with features and advantages thereof, may best be understood by reference to the following detailed description when read in conjunction with the accompanying drawings.

Figure 1:
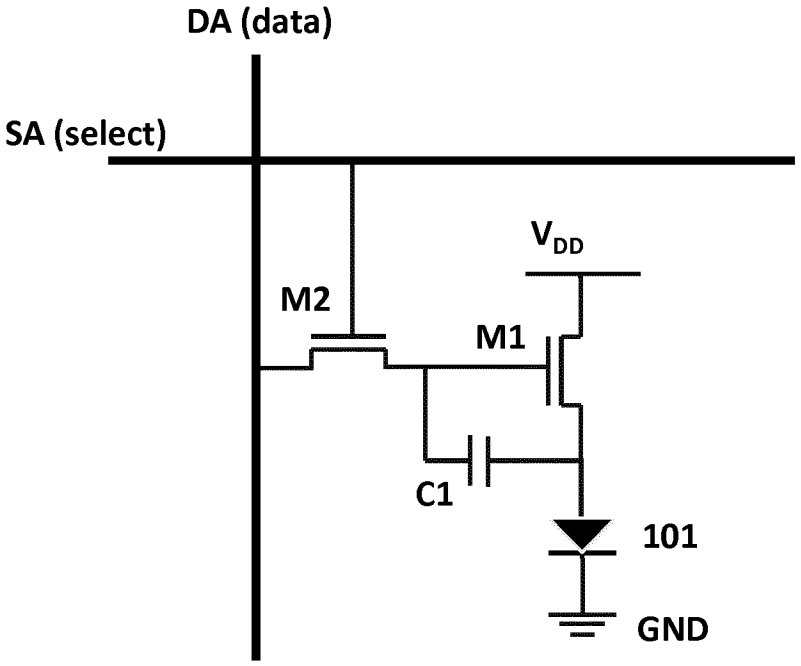
FIG. 1 (PRIOR ART)
FIG. 1 schematically shows an example of a prior art AMOLED pixel driver circuit, wherein an analog voltage on the gate of the drive transistor M1 determines the OLED luminance.

In the different drawings, the same reference signs refer to the same or analogous elements. Any reference signs in the claims shall not be construed as limiting the scope.

DETAILED DESCRIPTION OF ILLUSTRATIVE EMBODIMENTS

In the following detailed description, numerous specific details are set forth in order to provide a thorough understanding of the present invention and how it may be practiced in particular embodiments. However, it will be understood that embodiments of the present invention may be practiced without necessarily having all these specific details. In other instances, well-known methods, procedures and techniques have not been described in detail, so as not to obscure the present disclosure. While the present invention will be described with respect to particular embodiments and with reference to certain drawings, the invention is not limited hereto. The drawings included and described herein are schematic and are not limiting the scope of the invention. It is also noted that in the drawings, the size of some elements may be exaggerated and, therefore, not drawn to scale for illustrative purposes.

The terms first, second, third and the like in the description, are used for distinguishing between similar elements and not necessarily for describing a sequence, either temporally, spatially, in ranking or in any other manner. It is to be understood that the terms so used are interchangeable under appropriate circumstances and that the embodiments of the disclosure described herein are capable of operation in other sequences than described or illustrated herein.

Moreover, the terms top, bottom, over, under and the like in the description are used for descriptive purposes and not necessarily for describing relative positions. It is to be understood that the terms so used are interchangeable under appropriate circumstances and that the embodiments of the invention described herein are capable of operation in other orientations than described or illustrated herein. For instance, particular embodiments of the present invention may comprise a driving circuit for an AMOLED, and in the context of the present disclosure, a bottom electrode of an OLED would be for example the electrode of the OLED being closest to, e.g. part of, the active matrix of the AMOLED display. A top electrode of an OLED would then be the electrode opposite to the bottom electrode. The actual orientation of the AMOLED is hereby not taken into account.

It is to be noticed that the term "comprising" should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B.

OLED displays are displays comprising an array of light-emitting diodes in which the emissive electroluminescent layer is a film of organic compound which emits light in response to an electric current. OLED displays can either use passive-matrix (PMOLED) or active-matrix (AMOLED) addressing schemes. In case of OLED displays, the present invention relates to AMOLED displays. The corresponding addressing scheme makes use of a thin-film transistor backplane to switch each individual OLED pixel on or off. AMOLED displays allow for higher resolution and larger display sizes than PMOLED displays.

The present invention, however, is not limited to AMOLED displays, but in a broader concept relates to any type of active matrix displays in general. Any type of active matrix displays may use the concepts of embodiments of the present invention, although AMOLED displays are particularly advantageous in view of the current switching speeds of their pixel elements. It is advantageous if the pixel elements of the active matrix displays can switch faster, as this allows to obtain higher frame rates, hence less flickering images.

An active matrix display, e.g. an AMOLED display, according to embodiments of the present invention comprises a plurality of pixels, each comprising a light emitting element, e.g. an OLED element. The light emitting elements are arranged in an array, and are logically organised in rows and columns. Throughout the description of the present invention, the terms "horizontal" and "vertical" (related to the terms "row" or "line" and "column", respectively) are used to provide a co-ordinate system and for ease of explanation only. They do not need to, but may, refer to an actual physical direction of the device. Furthermore, the terms "column" and "row" or "line" are used to describe sets of array elements which are linked together. The linking can be in the form of a Cartesian array of lines and columns; however, the present invention is not limited thereto. As will be understood by those skilled in the art, columns and lines can be easily interchanged and it is intended in this disclosure that these terms be interchangeable. Also, non-Cartesian arrays may be constructed and are included within the scope of the present invention. Accordingly the terms "row" or "line" and "column" should be interpreted widely. To facilitate in this wide interpretation, the description and claims refer to logically organised in rows and columns. By this is meant that sets of pixel elements are linked together in a topologically linear intersecting manner; however, that the physical or topographical arrangement need not be so. For example, the rows may be circles and the columns radii of these circles and the circles and radii are described in this invention as "logically organised" rows and columns. Also, specific names of the various lines, e.g. select line and data line, are intended to be generic names used to facilitate the explanation and to refer to a particular function and this specific choice of words is not intended to in any way limit the invention. It should be understood that all these terms are used only to facilitate a better understanding of the specific structure being described, and are in no way intended to limit the invention.

In the context of the present invention, a current driver is a device adapted for driving current through light emitting elements of an active matrix display. In particular in the context of the present invention, a current driver is associated to a column of pixels of the display. A current driver is adapted to flow a current through the light emitting elements of the column associated with the current driver, and light emitting elements of pixels of a column receive current from a current driver associated with that column.

The present invention relates to a method and a driving circuit for controlling active matrix displays, such as for instance, but not limited thereto, AMOLED displays. The invention is not restricted either by the type of active matrix, which may comprise n-type or p-type TFTs, for instance MOSFET. Additionally, embodiments may comprise light emitting elements, for instance OLEDs, of any suitable type.

In one aspect, a method for controlling digitally driven active matrix displays is provided, wherein current control through the light emitting elements of the pixels is performed at column level instead of at pixel level. In this aspect, current through the light emitting elements may be controlled by external circuitry rather than by a drive transistor inside each pixel. The external column driver circuits can advantageously be based on semiconductor circuits, for instance monocrystalline semiconductor circuits (which provides a good homogeneity between the characteristics of different transistors manufactured in a same substrate), the present invention not being limited thereto. It is an advantage of this approach that current control can be done using external integrated circuits, and therefore current control can be more accurate.

Figure 2:
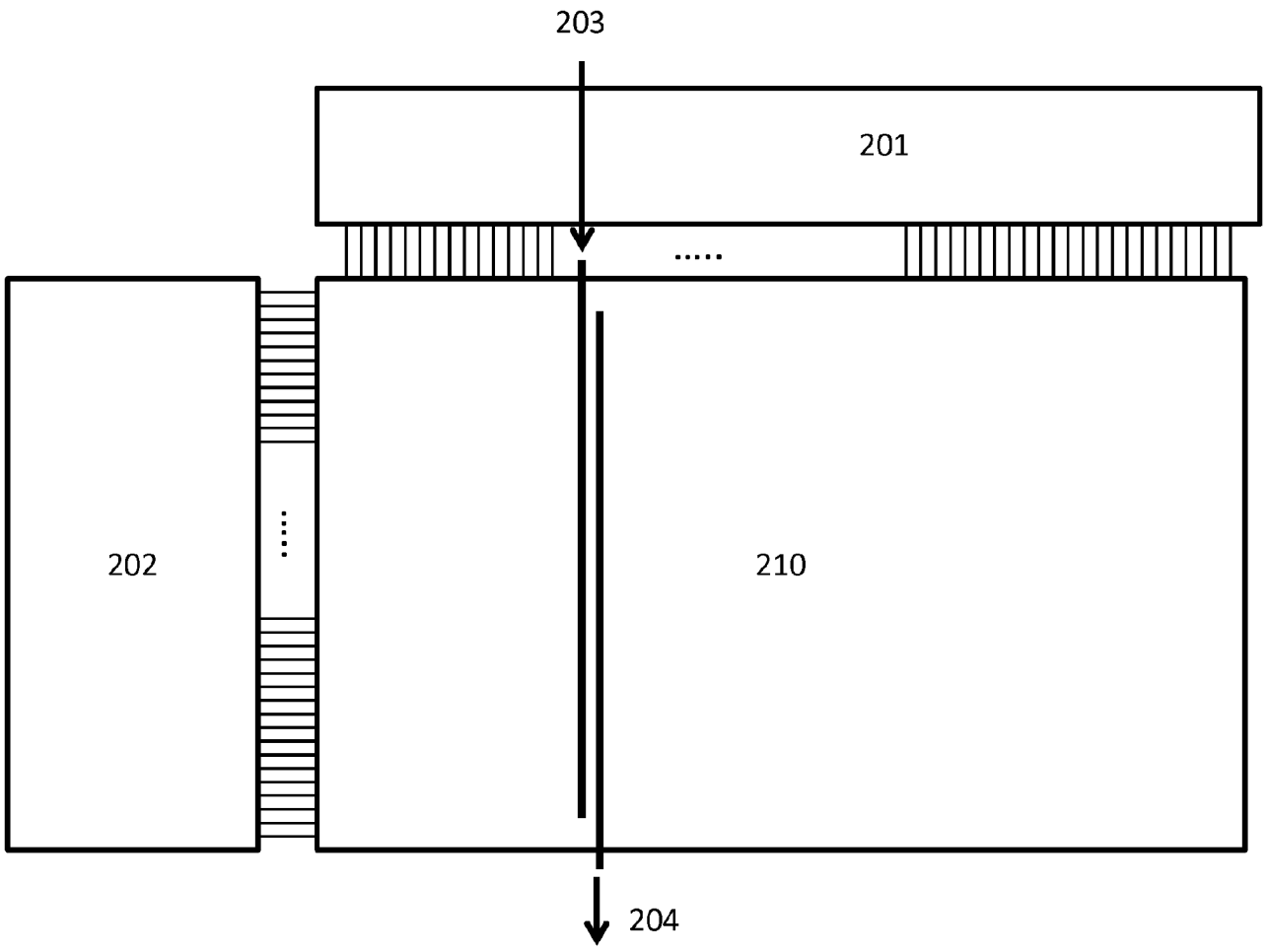
FIG. 2 schematically illustrates an architecture of an active matrix display according to embodiments of the present invention wherein current is controlled at column level.

In another aspect, the present invention relates to digital data line driving circuitry 201 for driving an active matrix display 210. Digital data line driving circuitry 201 comprising a plurality of current drivers (column drivers), schematically shown in FIG. 2, is provided, e.g. one current driver 203 per column of the display 210, coupled to ground or a current sink 204. Each current driver 203 is adapted for driving a predetermined current through its associated column, the current for each column being selected so as to be proportional to the number of light emitting elements that are ON in that column. The light emitting elements are digitally driven, meaning that they are either ON or OFF. The light intensity emitted by the light emitting elements is not related to a grey level to be displayed, but such grey level is obtained by timing of the driving of the light emitting elements, for instance by pulse width modulation.

The current drivers can be, for example, external chips with a DAC (Digital to Analog Converter) for each column. FIG. 2 schematically shows a display architecture with digital data line driving circuitry 201 comprising current drivers 203 wherein current is controlled at column level. For each column, the current is controlled such that it is proportional to the number of light emitting elements that are ON in that column. Changes in data on the data line may change the number of light emitting elements that are ON, hence in advantageous embodiments, means for updating the current delivered by the current drivers 203 are comprised in the digital current driver 203 itself. For example, a counter may be included for updating the current in each column, synchronised with data input, the present invention not being limited thereto.

Digital select line driving circuitry 202 is used for sequentially selecting each of the plurality of rows of the display 201 (for instance, comprising timing control circuitry), and digital data line driving circuitry 201 is used for writing digital image codes to the pixels in a selected row.

In particular embodiments of the present invention, the drive transistors of the pixels may be driven in the linear regime, with a source-drain voltage $V_{SD}$ typically lower than 0.1 V, although the invention is not limited to that value. The drive transistors can be operated as (compensated) select transistors. This advantageously results in a substantial reduction of power consumption in the active matrix as compared to configurations wherein the drive transistors are driven in saturation, e.g. for good current control. In aspects of the present invention output resistance of the drive transistor is not an issue. Therefore, as compared to drive transistors in existing pixel driving circuits, circuitry may be made simpler, while reducing cross talk. Moreover, as it is not required to drive the drive transistor M1 in saturation but as it can be driven, in accordance with embodiments of the present invention, in the linear regime, there is no need to fulfil saturation-related conditions (such as low output resistance), and the channel length of the drive transistor M1 can be reduced (for example to 1 μm or less) and the channel width of the drive transistor M1 can be increased while still maintaining a compact pixel design.

In order to enable an accurate current control in embodiments of the present invention, the predetermined current of a column is preferably driven between a first line and a second line that accurately match in resistance over the length of the column, such that the resistive path is equal for each light emitting element in the column. In prior art displays, the current is driven between a first line and a second line, the second line corresponding to a common top electrode which is a common plane for all light emitting elements in the display. In such devices using a common top electrode plane, resistive drops depend on the number of light emitting elements being ON. This problem is solved in embodiments of the present invention.

Figure 3:
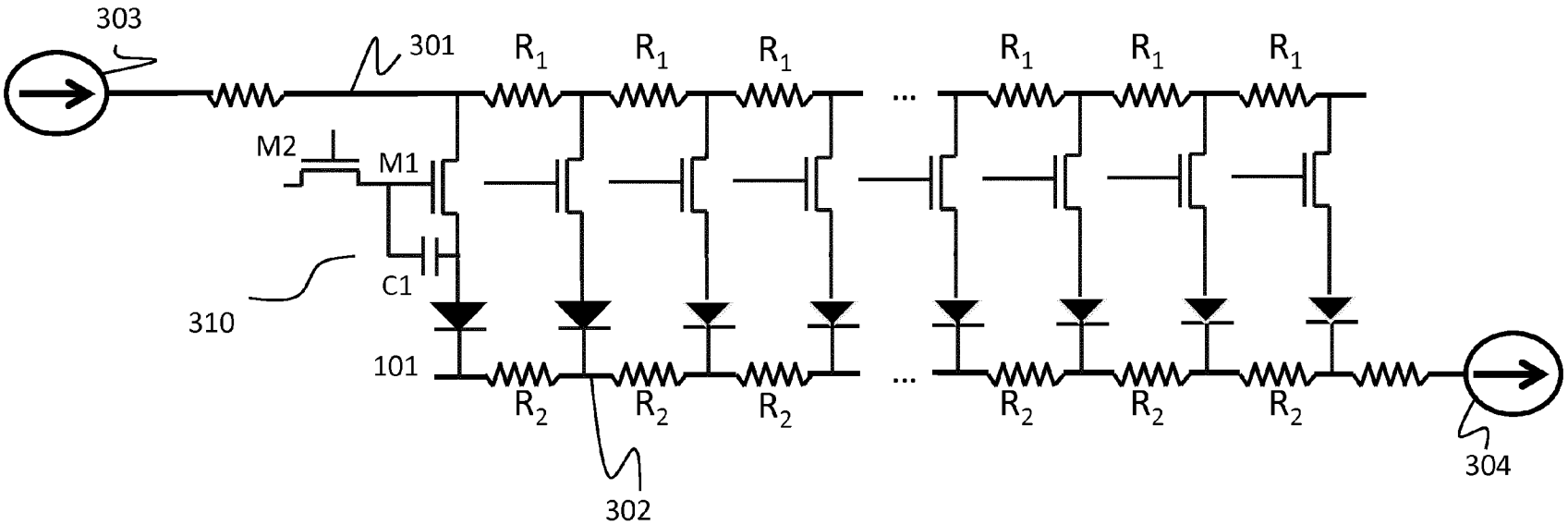
FIG. 3 is a schematic representation of a column, showing a plurality of pixels each having a light emitting element, for instance an OLED, that can be used in the architecture of FIG. 2.

FIG. 3 is a schematic representation of a column in a display architecture according to embodiments of the present invention, showing a plurality of pixels electrically connected in parallel to a controlled current source 303, and to a controlled current sink or common ground 304. Any, or both, of the controlled current source 303 and the controlled current sink or ground 304 may advantageously be implemented on an external driver chip. In the example shown in FIG. 3, each of the pixels comprises pixel circuitry as in FIG. 1. However, the present invention is not limited to those pixel circuitry configurations illustrated, and other pixel implementations could be used as well. FIG. 3 only shows this pixel circuitry 310 in detail for one single pixel, but all pixels are considered to have the same circuitry; for instance all pixels may comprise a light emitting element 101, a select transistor M2 and a capacitor C1 connected to the drive transistor M1 and to the light emitting element.

Figure 4:
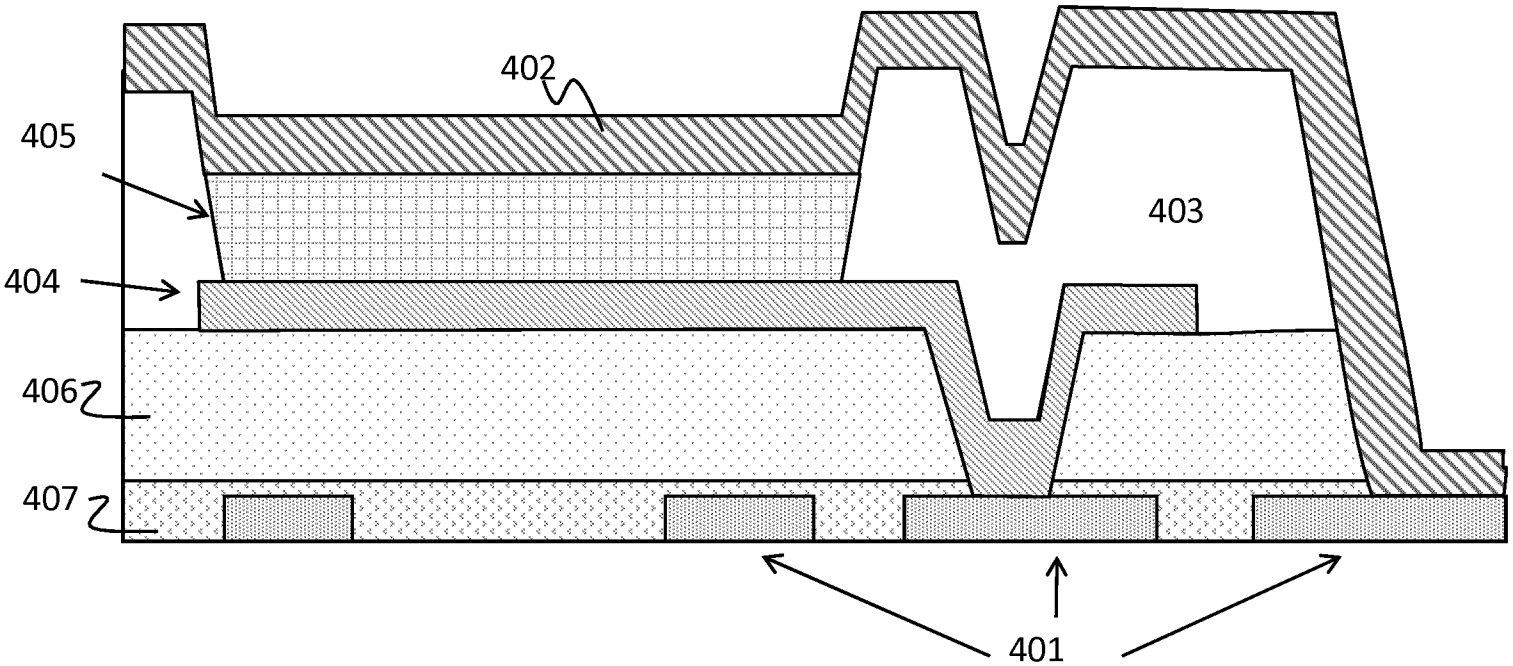
FIG. 4 illustrates an OLED top electrode connected to a backplane metal layer through a via.

The column current is driven between a first line 301 comprising $R_1$ resistances between every parallel connection of the pixels and a second line 302 comprising $R_2$ resistances between every parallel connection of the pixels. In particular embodiments all $R_1$ resistances are substantially equal to all $R_2$ resistances. The $R_1$ resistances are typically related to the metal interconnect wiring on the backplane of the display. For example, this can be typically a 30 nm thick Mo layer or a 30 nm thick Au layer. The $R_2$ resistances correspond to the top electrode wiring, typically comprising a transparent metal oxide. Such transparent metal oxides have substantially higher resistances than metals. Therefore, to enable the realization of equal resistive paths for all light emitting elements 101 in a column (which may comprise, in certain embodiments, OLEDs), in embodiments of the present invention measures are taken to obtain resistance matching between the first line 301 and the second line 302. Such resistance matching may for example be obtained by connecting the top electrode of each light emitting element back to the same metal layer used in the backplane, as for example illustrated in FIG. 4. The metal layer 401 of the backplane can be connected to the top electrode 402 (which may be otherwise isolated by the edge cover 403) and to the bottom electrode 404 of each active element layer stack (for instance, an OLED) 405. The bottom electrode 404 may be otherwise isolated by the interlayer 406 and passivation layer 407. By realizing $R_1$ and $R_2$ in the same metal layer, $R_1$ and $R_2$ can be matched by design. The exemplary scheme shown in FIG. 4 focuses on the resistance matching, and it may be part of a layer stack, for instance part of a flexible layer, which is not shown for simplification. It is to be noted that the present invention is not limited to the embodiment shown in FIG. 4, and other implementations matching the top line and bottom line resistance can be used. For example, as an alternative to resistance matching by design, resistance matching can be obtained based on technology modifications and by materials choice.

Compensation (as further described) can be used to obtain equal voltages over the pixels (drive transistor/light emitting element units). This allows obtaining equal currents through each of the light emitting elements, without the need for an accurate current control in each individual pixel. As a consequence, pixels can be also made smaller and thus higher resolution displays can be realized.

Figure 5:
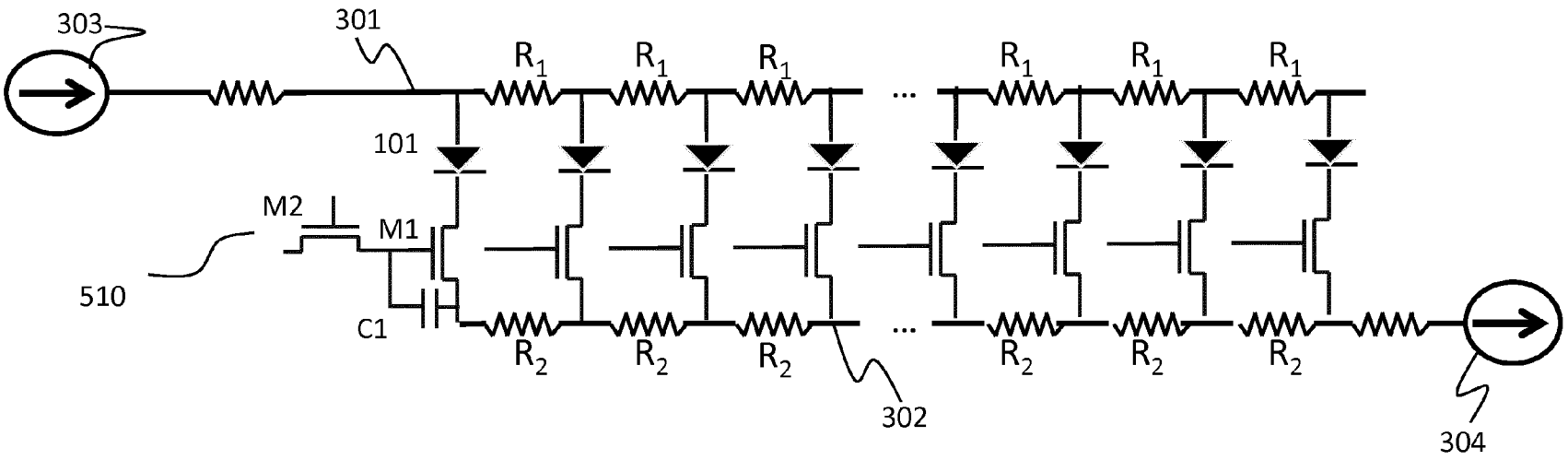
FIG. 5 is a schematic representation of an alternative column, showing a plurality of pixels, that can be used in the architecture of FIG. 2.

The schematic figure shown in FIG. 3 can be further improved as shown in FIG. 5, by interchanging the position of the drive transistor M1 and the light emitting element in the pixel circuit 510. The gates of the drive transistors M1 in FIG. 5 can be digitally driven between the ground and the power voltage (of both the display and the driver chips). This substantially reduces the design complexity. Additionally, as before, first resistors $R_1$ may be provided on the first line 301 between the parallel coupled pixels in a column, and second resistors $R_2$ may be provided on the second line 302 between the parallel coupled pixels in the column, and all first resistances $R_1$ may be substantially equal to second resistances $R_2$.

Normally, resistance matching is not enough to drive all the light emitting elements which are ON at the same current $I_{ref}$ and the same (preferred) voltage drop $V_L$*. Differences may stem from, for example, differences in transistor characteristics, change of temperature, aging, and other causes. It is possible to ensure that a preferred voltage drop $V_L$* is obtained over each combination of a drive transistor M1 and a light emitting element, at the reference current $I_{ref}$, i.e. the current through a single pixel when it is ON. For instance, voltage drop compensation of the drive transistors may be applied. This can for example be done by means of a so-called 3T2C (3 transistors, 2 capacitors) pixel circuitry design, the present invention not being limited thereto. For example, drive transistors M1 with a back-gate can be used as illustrated in FIG. 6 and FIG. 7.

Figure 6:
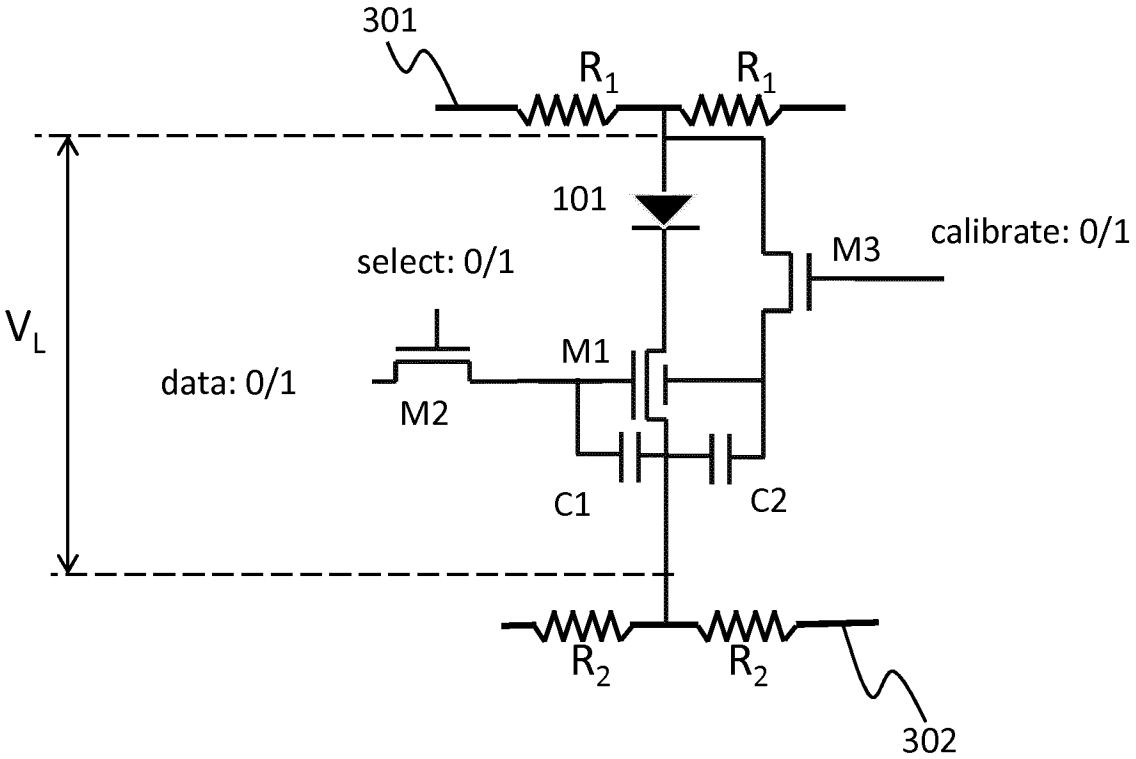
FIG. 6 shows an example of a pixel driver circuit according to embodiments of the present invention that can be used for voltage drop compensation using a back-gate.
Figure 7:
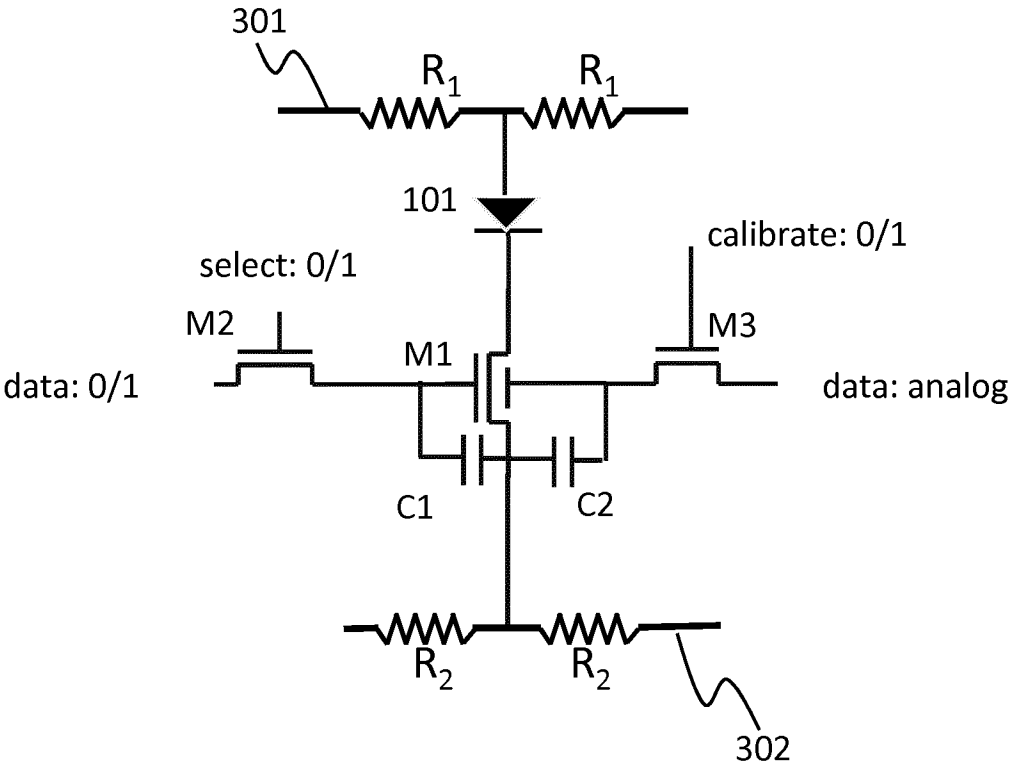
FIG. 7 shows an example of a pixel driver circuit according to embodiments of the present invention that can be used for voltage drop compensation using a back-gate.

The circuits illustrated in FIG. 6 and FIG. 7 are analogous to pixel circuit 510 in FIG. 5, further comprising a calibration transistor M3, connected with one of its main electrodes to the back-gate of drive transistor M1. In the embodiment illustrated in FIG. 6, the transistor M3 may be connected in the resistive path of the pixel, meaning that the second main electrode of the transistor M3 is coupled to the electrode of the light emitting element 101 coupled to the first line 301.

In the embodiment illustrated in FIG. 7, the transistor M3 is not connected in the resistive path of the pixel, one of the main electrodes of the transistor M3 being coupled to the back-gate of the drive transistor M1, and the other main electrode being connected to a data circuit (not illustrated in FIG. 7). In both cases, the gate of the calibration transistor M3 is coupled to a calibration line, adapted for receiving a calibration signal.

Figure 8:
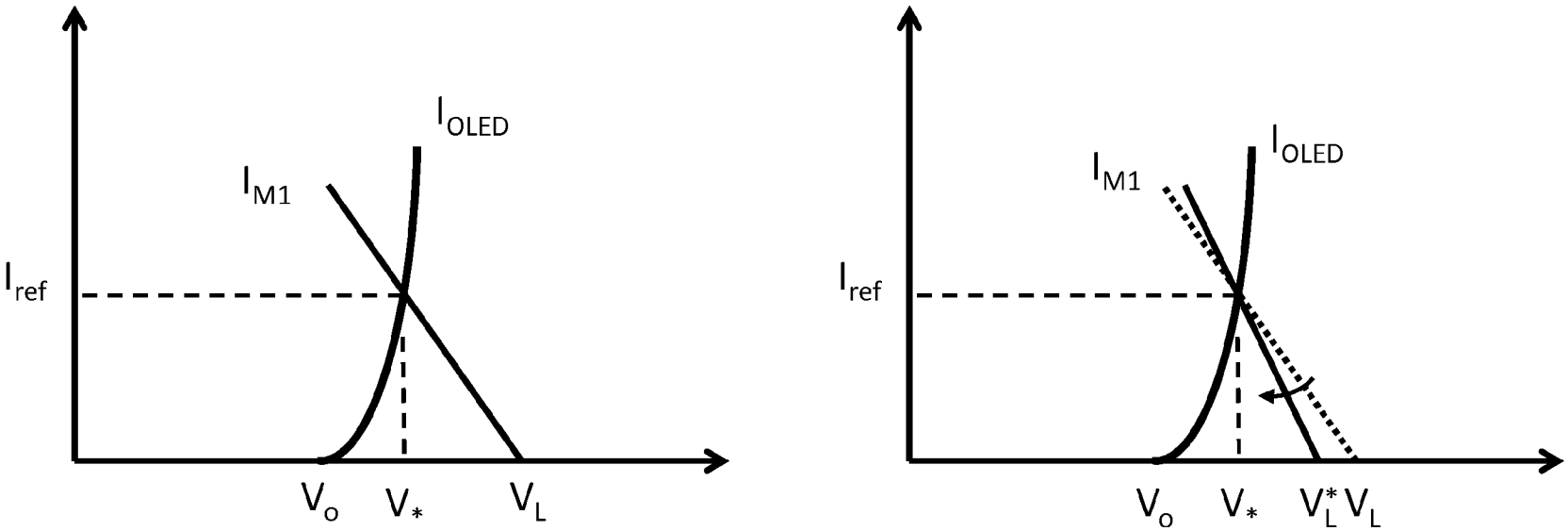
FIG. 8 illustrates a voltage drop compensation method according to embodiments of the present invention that can be applied using a pixel driver circuit as shown in FIG. 6 or FIG. 7.

The voltage drop in each pixel of a column can be homogenised by drawing all voltage drops to, for instance, the lowest in the column, as can be seen in FIG. 8, in which the voltage $V_L$ is calibrated to $V^*_L$. It may be done via digital means (FIG. 6) or analog means (FIG. 7), although the need of an additional connection or current source for this analog compensation may result in an increase of circuitry elements, with a possible increase of total pixel size. Nonetheless, it may be an advantageous embodiment in certain applications in which exact tuning of the current intensity is fundamental. The calibration procedure will be explained in more detail below.

The present invention is not limited to the circuits for compensation shown in FIG. 6 and FIG. 7. For instance, different transistors and configurations may be used. The circuit shown in FIG. 9 does not contain back-gate connections. It comprises a calibration transistor M4 between gate and drain of drive transistor M1 (or gate and emitter, depending on the type of transistor used). Again, the gate of calibration transistor M4 is connected to a calibration line adapted for receiving a calibration signal. This may increase the voltage drop using the data line. The present invention is not limited to the type of transistor.

Figure 10:
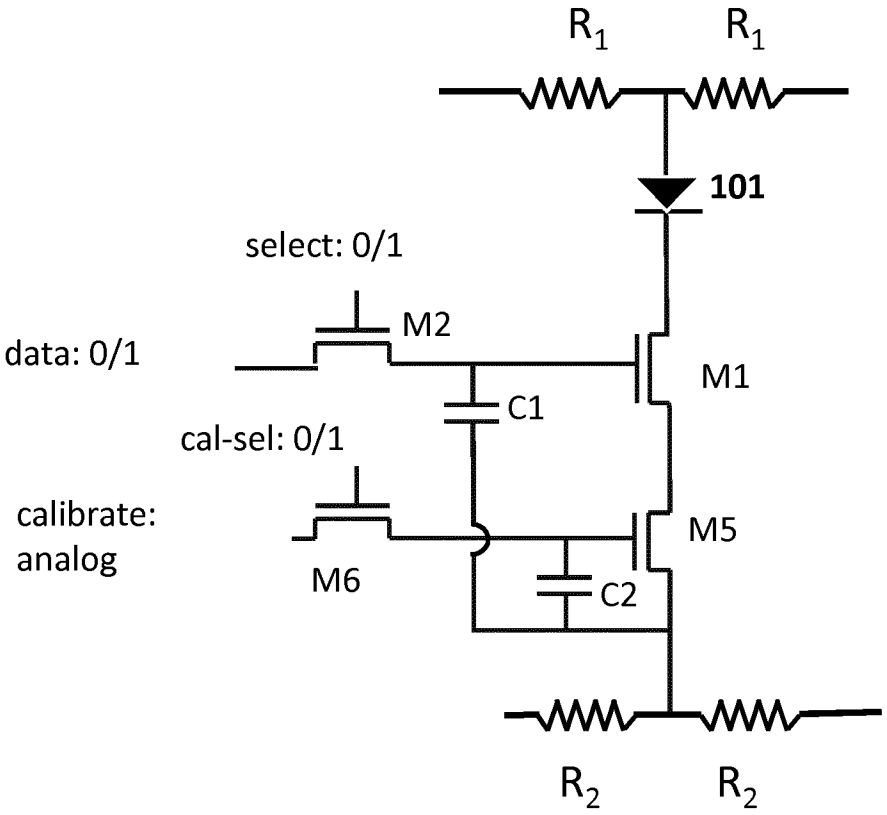
FIG. 10 shows an example of a pixel driver circuit according to embodiments of the present invention that may be used for voltage drop compensation without using a back-gate.

The present invention is not limited either to implementations with two or three transistors. FIG. 10 shows a configuration with four transistors, drive transistor M1, select transistor M2, a further drive transistor M5 connected in series with drive transistor M1 and calibration transistor M6 for controlling the calibration and connected to the gate of the further drive transistor M5. The gate voltage of the further drive transistor M5 may be reduced (analog control) and hence compensation of the voltage drop in the pixel may be obtained.

The present invention is not limited by these particular embodiments, and it may be applied to p-type as well as n-type transistors. As well, the driving circuitry may comprise a back-plane further comprising TFT, for instance hydrogenated amorphous Si (a-Si:H), polycrystalline silicon, organic-semiconductor, (amorphous) indium-gallium zinc oxide (a-IGZO, IGZO) TFT, not being limited thereto. The present invention may be applied to displays using active matrix, not being limited by a particular type of display. For instance, it may be applied to AMOLED displays, for instance RGB or RGBW AMOLED, which may comprise fluorescent or phosphorescent OLED, polymer or polydendrimers, high power efficiency phosphorescent polydendrimers, etc.

In the first aspect of the present invention, a method for digital driving of an active matrix display is disclosed. The display may contain a plurality of pixels, each pixels comprising a light emitting element, organized in a plurality of rows and a plurality of columns. The method comprises sequentially selecting each of the plurality of rows using digital select line driving circuitry, for instance using a clock signal but not limited thereto; writing digital image data to the pixels in a selected row using digital data line driving circuitry, for example in a multiplexing display configuration, the present invention not limited thereto; and driving a predetermined current through each column, the predetermined current for a given column being proportional to the number of pixels that are ON in that column.

The method may further comprise updating the predetermined current with the changes in the state of the pixels in the column. For instance, when a pixel turns OFF, the current changes accordingly so it is proportional to the new number of pixels that are ON. This can be controlled by a counter, for example a circuit comprising an up/down counter, the present invention not being limited thereto. The current may be converted to an analog signal, for instance via a digital to analog converter, and connected to the pixels in each column via a first line 301 with a first resistive path, the pixels further connected to a second line 302 with a second resistive path acting as current sink 304 or as a ground. In advantageous embodiments of the present invention, the first and second resistive path are equal or substantially equal, so the pixels of each column are driven by substantially the same current. Here, "substantially the same current" may be understood as currents which differ less from one another than required to produce a noticeable difference in pixel intensity, at least for the human eye. Hence, the resistive path of the column does not depend of the number of ON pixels, without a current control for each pixel being necessary.

Despite the homogeneity of current in each column, select line and data line in the active matrix may further comprise transistors. Slight differences in said transistors (due to manufacture, temperature, etc) may produce slightly uneven driving. The present invention, in addition, enables driving the transistors in the linear region, which means that the differences may be even more pronounced, making the introduction of a calibration and compensation step advantageous.

A method for voltage calibration will be described as an example of certain embodiments of the present invention.

First a calibration procedure is performed to determine the preferred voltage drop $V_L^*$ over the combination of drive transistor(s) M1, M5 and light emitting element 101. During the calibration procedure the light emitting elements 101 in a column are driven sequentially, such that a single light emitting element 101 is driven (ON) at a time. For each light emitting element that is ON, the voltage $V_L$ is determined as explained below. The lowest voltage $V_L$ within a column (i.e. $V_L^*$) is then selected as the preferred voltage drop. This procedure is repeated for each column of the display. The calibration procedure is typically done upon turning on the display, and afterwards it can be repeated regularly, such as e.g. once per hour for re-calibration to compensate dynamic effects, like temperature. The preferred voltage drop $V_L^*$ can be different for different columns. A compensation circuit, such as for example any of the circuits shown in FIG. 6 and FIG. 7, can be used to yield the predetermined voltage drop $V_L^*$ for each of the pixels in a column. The compensation method is schematically illustrated in FIG. 8.

The procedure for obtaining the predetermined voltage $V_L^*$ over the transistor and pixel driver under the reference current $I_{ref}$, using the circuit of FIG. 6, shall be described as follows as an example of voltage compensation. During the calibration procedure, calibration transistor M3 is activated (calibration signal high, e.g. logical 1) for all pixels when the display is OFF. This discharges the back-gate of drive transistors M1. Subsequently the display is driven row by row (activation of select transistor M2 and flowing $I_{ref}$ through the column) and the voltage $V_L$ is measured over each column, i.e. the voltage drop over the combination of light emitting element and drive transistor M1. $V^*$ is the voltage drop over the light emitting element when the reference current is driven through it, and this value is known for each light emitting element. The voltage drop over drive transistor M1 is then $V_L$-V*. The predetermined voltage $V_L$* for a column is selected as the lowest voltage among all measured $V_L$ values in that column. Subsequently calibration transistor M3 is opened using short digital pulses until the voltage drop $V_L$ reaches the predetermined voltage level $V_L$* for each of the pixels in the column. This is schematically illustrated in FIG. 8.

A similar calibration procedure can be followed using the schematic shown in FIG. 7. After activation of select transistor M2 and charging of the gate of the drive transistor M1 of the only active pixel in the column, select transistor M2 is deactivated again, keeping the current $I_{ref}$ through the light emitting element flowing. Subsequently calibration transistor M3 is activated to charge the back-gate to the voltage needed to bring the voltage $V_L$ gradually down to the preferred voltage drop $V_L$*. The analog data lines for calibration can be shared with digital data lines during operation.

A difference between the embodiments shown in FIG. 6 and FIG. 7 is that the schematic of FIG. 6 uses digital pulses to move $V_L$ downward. The schematic of FIG. 7 uses analog control voltages to control $V_L$. The latter can be done more accurately, but will probably be too bulky in a final implementation, as already mentioned. The implementation of FIG. 6 is fully digital but can only move $V_L$ downward, not upward. Normally, the backgate voltage is initially zero, and a higher voltage can be applied on the backgate to decrease the resistance. This leads to a steeper resistor/transistor load line and hence a lower $V_L$ (as illustrated in FIG. 8). The implementation in FIG. 7 can move $V_L$ upward, as in FIG. 9 and FIG. 10. Hence the embodiment illustrated in FIG. 7 has an additional advantage: if overcompensation has been done, the voltage at the backgate can be reduced again afterwards, leading to an increase of $V_L$, as illustrated in FIG. 11.

Figure 9:
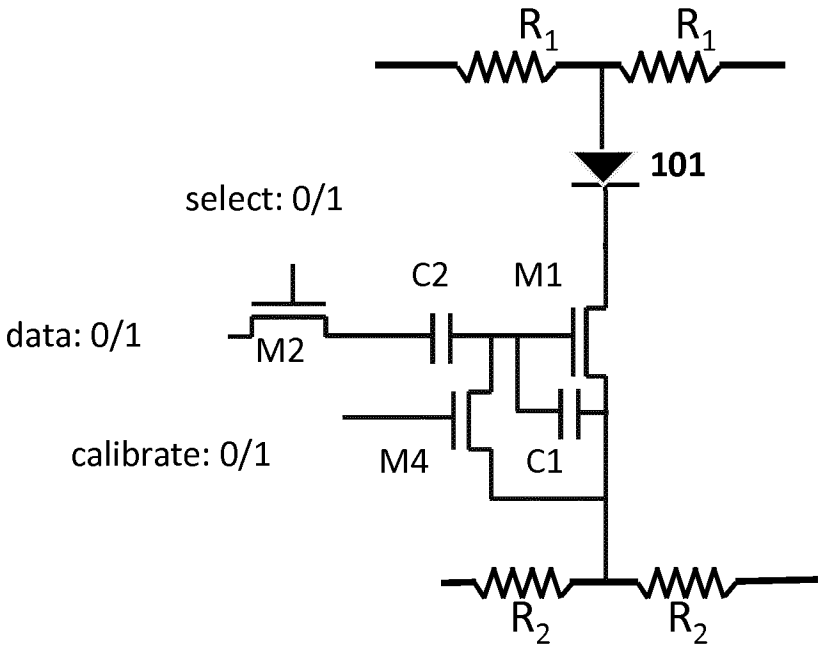
FIG. 9 shows an example of a pixel driver circuit according to embodiments of the present invention that may be used for voltage drop compensation without using a back-gate.

Thin film transistors with a back-gate are not available in all state-of-the-art technologies. Compensation is also possible for display technologies that have no access to back-gate technologies. For these technologies, for example a 3T2C pixel driver, as illustrated in FIG. 9, can be used. Calibration of the voltage $V_L$ can be obtained as follows: initially select transistor M2 and calibration transistor M4 are activated to discharge capacitor C2. The voltage drop $V_L$ over the combination of drive transistor M1 and light emitting element 101 is measured for all pixels in a column. The voltage drop $V_L$ can then be increased where needed by activating select transistor M2 and calibration transistor M4 and applying a voltage (or subsequent short digital pulses) on the data line. In an embodiment without back-gate as illustrated in FIG. 9, the voltage drop $V_L$ can only be increased, unless negative voltages could be applied on the data line. Applying negative voltages would, however, require much more complex designs. Compared to the pixel circuits shown in FIG. 6 and FIG. 7, the circuit of FIG. 9 has a lower current at equal size.

Another embodiment of a pixel driver circuit with an additional transistor M5 in the current path is shown in FIG. 10. Transistor M5 is normally driven fully ON (e.g. at the power voltage). However, in order to have all equal voltage drops $V_L$ over all pixels at the reference current $I_{ref}$, the gate voltage on supplementary drive transistor M5 (and supplementary capacitor C2) can be reduced using analog control, for instance with a calibration transistor M6.

Figure 11:
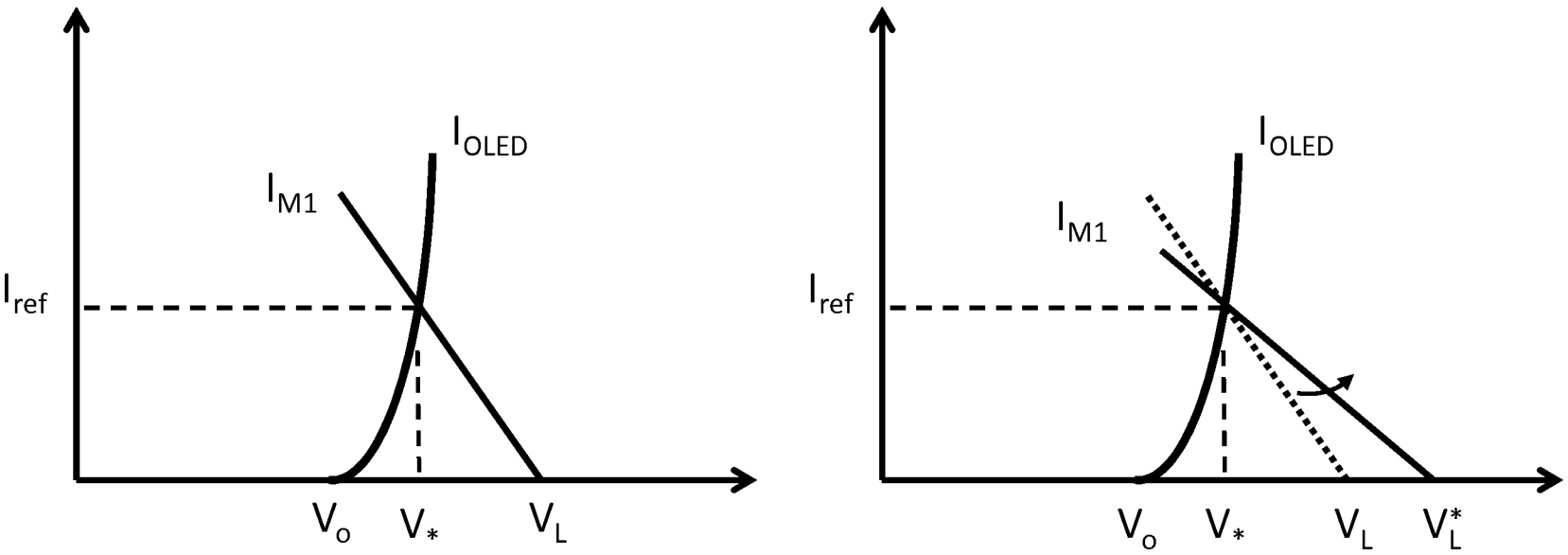
FIG. 11 illustrates a voltage drop compensation method according to embodiments of the present invention that can be applied using a pixel driver circuit as shown in FIG. 9 or FIG. 10.

FIG. 11 illustrates a calibration method corresponding to both pixel driver circuits as shown in FIG. 9 and FIG. 10. These driver circuits may adjust the voltage to a higher value, $V_L$*>$V_L$, as is the case of the embodiment shown in FIG. 9. If during calibration the resistance of the transistor is increased, the slope of the load line is reduced, resulting in a higher $V_L$*.

Figure 12:
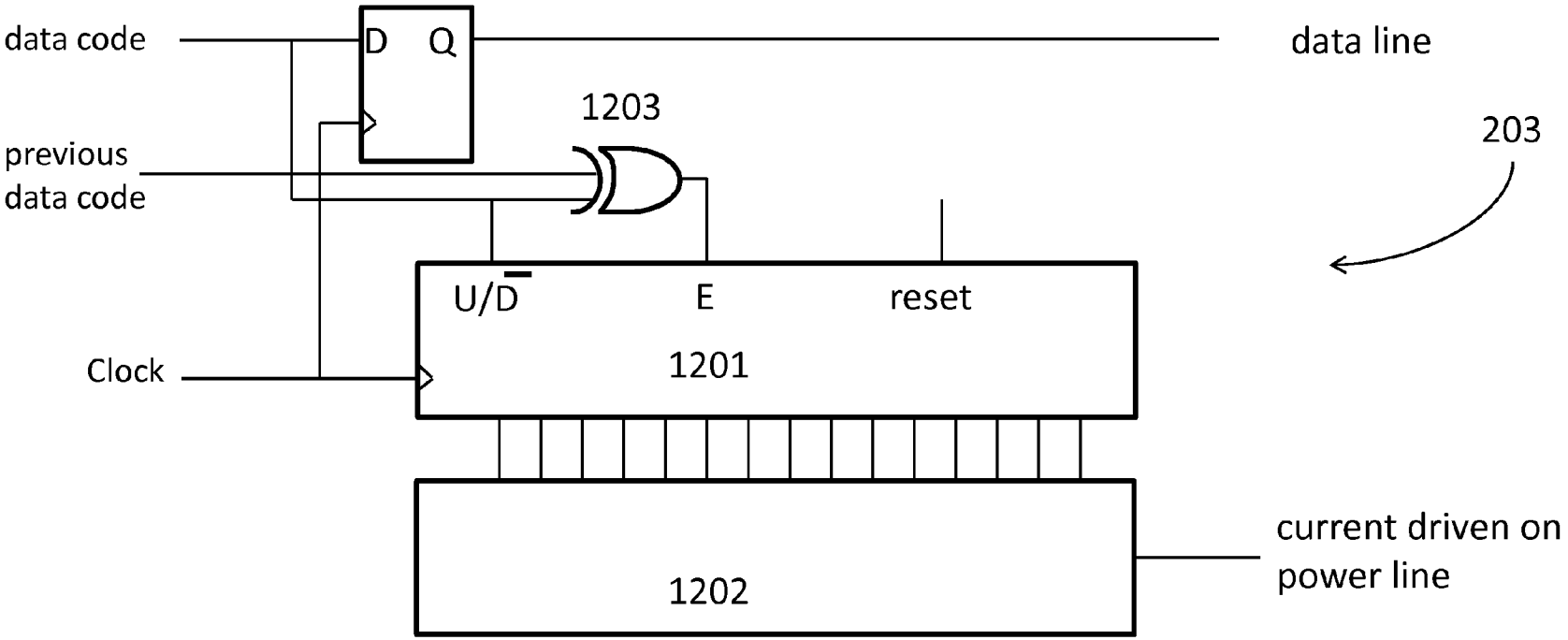
FIG. 12 schematically illustrates an example of a compact implementation of a current driver for the columns of an AMOLED display in accordance with embodiments of the present invention.

FIG. 12 schematically illustrates an example of a compact implementation of a current driver 203 that can be used for driving a column of an active matrix display according to embodiments of the present invention. A current driver 203 is provided for each column. An image data code (digital bit) and the previous image data code are compared by the EXOR gate 1203 and its output is driven to for example an up/down counter, for example a synchronous up/down counter, advantageously a compact clocked up/down counter 1201 driving an n-bit current DAC. The counter stores a natural number equal to the number of light emitting elements that is ON in the corresponding column at a given moment in time. Updating of the natural number stored in the counter 1201 is done at each clock pulse, synchronized with the select line driving circuitry, and in accordance with digital image data. Upon changing the status of a light emitting element in a given column from OFF to ON, the number stored in the counter 1201 is increased by 1. Upon changing the status of a light emitting element in a given column from ON to OFF, the number stored in the counter 1201 is decreased by 1. The predetermined current driven through the corresponding column is equal to the natural number stored in the counter 1201 multiplied with a predetermined reference current $I_{ref}$. The current DACs (one for each column) should be carefully designed to obtain current linearity over the display.

It is an advantage of controlling the current by external column drivers according to embodiments of the present invention that the power consumption of the display can be substantially reduced. The drive transistors in the pixels operate in the linear regime and are hence able to drive the current through the light emitting elements at a very low voltage drop (e.g. $V_{sD}$<0.1 V). The drive transistors act as compensated switches and the resistive network over a column is accurately matched.

The foregoing description details certain embodiments of the disclosure. It will be appreciated, however, that no matter how detailed the foregoing appears in text, the disclosure may be practiced in many ways. It should be noted that the use of particular terminology when describing certain features or aspects of the disclosure should not be taken to imply that the terminology is being re-defined herein to be restricted to including any specific characteristics of the features or aspects of the disclosure with which that terminology is associated.

While the above detailed description has shown, described, and pointed out novel features of the invention as applied to various embodiments, it will be understood that various omissions, substitutions, and changes in the form and details of the device or process illustrated may be made by those skilled in the technology without departing from the spirit of the invention.

The invention claimed is:

1. Digital driving circuitry for driving an active matrix display, the display comprising a plurality of pixels logically organized in a plurality of rows and a plurality of columns, each pixel comprising a light emitting element, wherein the driving circuitry comprises:

current driver circuitry for each of the plurality of columns and configured to drive a predetermined current through the corresponding column, the predetermined current being proportional to the number of pixels that are ON in that column, a first line with a first resistive path and a second line with a second resistive path between which the predetermined current is configured to be driven through each column, wherein the resistance of the first resistive path is substantially equal to the resistance of the second resistive path over a length of the first and second lines for all light emitting elements in each column, digital select line driving circuitry configured to sequentially select the plurality of rows, and digital data line driving circuitry configured to write digital image codes to the pixels in a selected row, synchronized with the digital select line driving; circuitry;

wherein each current driver circuitry contains a counter for storing a natural number equal to the number of light emitting elements that are ON in the corresponding column at a given moment in time, wherein the counter is synchronized with the select line driving circuitry and responsive to changes in the digital data line driving circuitry.

2. The digital driving circuitry according to claim 1, wherein the display comprises a backplane, and wherein the current driver circuitry is external to the display backplane.

3. The digital driving circuitry according to claim 1, wherein the current driver circuitry comprises monocrystalline semiconductor-based circuits.

4. The digital driving circuitry according to claim 1, wherein the counter is an up down counter.

5. The digital driving circuitry according to claim 1, further comprising a backplane comprising pixel driving circuitry connectable to the plurality of light emitting elements of the display, wherein each pixel driving circuitry comprises means for compensating differences in voltage drop between different pixels in a column, the voltage drop being determined over a series connection of the light emitting element and the pixel driving circuitry.

6. The digital driving circuitry according to claim 5, wherein the means for compensating further comprises means for applying digital compensation.

7. The digital driving circuitry according to claim 5, wherein the means for compensating further comprises means for applying analog compensation.

8. A method for digital driving of an active matrix display, the display comprising a plurality of pixels logically organized in a plurality of rows and a plurality of columns, the method comprising:

sequentially selecting each of the plurality of rows using digital select line driving circuitry;

writing digital image data to the pixels in a selected row using digital data line driving circuitry; and driving a predetermined current through each column, the predetermined current for a given column being proportional to the number of pixels that are ON in that column, wherein driving the predetermined current through each column comprises driving the predetermined current between a current source comprising a first resistive path and a current sink comprising a second resistive path, and wherein the resistances of the first and second resistive paths are substantially equal;

wherein, for each column, storing a natural number equal to the number of pixels that are ON in that column at a given moment in time, the number being synchronized with the select line driving circuitry and being updated according to changes in the data line driving circuitry.

9. The method according to claim 8, further comprising performing a calibration step, thereby determining a preferred voltage drop for each column and imposing that preferred voltage drop for each of the pixels in the corresponding column.

10. The method according to claim 9, wherein determining the preferred voltage drop comprises determining the voltage drop as a voltage difference over a series connection of the pixel and a pixel driving circuit coupled to the pixel.

* * * * *